US005972864A

United States Patent [19]

Counts

[11] Patent Number: 5,972,864

[45] Date of Patent: Oct. 26, 1999

[54] BLEACHING AND CLEANING COMPOSITIONS CONTAINING FRAGRANCES

[75] Inventor: Michael Wayne Counts, Bethlehem, Pa.

[73] Assignee: Lonza Inc., Fair Lawn, N.J.

[21] Appl. No.: 08/838,161

[22] Filed: Apr. 17, 1997

Related U.S. Application Data

[63] Continuation of application No. 08/800,321, Feb. 14, 1997, abandoned.

[51] Int. Cl.[6] ..... C11D 7/54; C11D 17/00

[52] U.S. Cl. ..... 510/192; 510/191; 510/367; 510/381; 510/446; 252/186.39; 422/37

[58] Field of Search ..... 510/367, 101, 510/501, 191, 192, 381, 446; 252/186.39; 422/37

[56] References Cited

U.S. PATENT DOCUMENTS

| | | | |
|---|---|---|---|
| 4,396,522 | 8/1983 | Callicott et al. | 252/163 |
| 4,579,677 | 4/1986 | Hooper et al. . | |
| 4,663,068 | 5/1987 | Hagemann et al. . | |
| 5,205,955 | 4/1993 | Bunczk et al. | 252/102 |
| 5,336,427 | 8/1994 | Bunczk et al. . | |
| 5,565,576 | 10/1996 | Hall et al. | 548/317.1 |

FOREIGN PATENT DOCUMENTS

| | | | |
|---|---|---|---|
| 0 206 725 | 12/1986 | European Pat. Off. . | |
| 0 503 751 A1 | 9/1992 | European Pat. Off. . | |
| 0 750 035 A2 | 12/1996 | European Pat. Off. . | |
| WO 92/19712 | 11/1991 | WIPO . | |
| WO 94/26863 | 11/1994 | WIPO . | |
| WO 97/00935 | 1/1997 | WIPO . | |
| WO 97/17180 | 5/1997 | WIPO | B29B 11/10 |
| WO 98/06804 | 2/1998 | WIPO . | |

*Primary Examiner*—Yogendra Gupta
*Assistant Examiner*—Gregory E. Webb
*Attorney, Agent, or Firm*—Darby & Darby

[57] ABSTRACT

The present invention is directed to a stable fragrant bleaching block which comprises (a) a bleaching agent having a reduction potential from about −0.7 v to about +0.4 v and (b) an organoleptic effective amount of a fragrant agent which (i) is stable to the bleaching agent, (ii) does not decompose the bleaching agent, and (iii) is not substantially hygroscopic. This invention also pertains to methods for making and employing the stable fragranced bleaching block.

7 Claims, No Drawings

BLEACHING AND CLEANING COMPOSITIONS CONTAINING FRAGRANCES

The present application is a continuation of Ser. No. 08/800,321 filed Feb. 14, 1997 which is now abandoned.

FIELD OF THE INVENTION

The present invention is directed to a shaped bleaching block containing a stable fragrant agent. The stable fragrant bleaching block comprises (a) a bleaching agent having a reduction potential from about −0.7 v to about +0.4 v compared to an Ag/AgCl electrode; and (b) an organoleptic effective amount of a fragrant agent which (i) is stable to the bleaching agent, (ii) does not decompose the bleaching agent, and (iii) is not substantially hygroscopic. This invention also pertains to methods for making and employing the stable fragranced bleaching block.

DESCRIPTION OF THE BACKGROUND

Odor is that property of a substance that makes it perceptible to the sense of smell. Specifically, odor is that property that is manifested by a physiological sensation caused by contact of the molecules of a substance with the olfactory nervous system. Although molecular structure is believed to influence odor, there is little correlation, at the present time, between odor and molecular structure.

Odor modification is the intentional change of one odor by the addition of another. The importance of odor modification is its usefulness as a method of odor control. Air fresheners, perfumes, and industrial deodorants are examples of odor modifiers. Perfumers employ the principles of odor modification by creating fragrances. Thus, odor modification refers specifically to the use of fragrance materials for odor control. Many odorous and nonodorous chemicals are used to control odors, but only those that work essentially by altering the way the nose perceives the character and intensity are true odor modifiers.

A problem in the field of odor modification is in the area of perfuming bleaching compositions. Because of the inherent ability of a bleaching agent to destroy odors, it is difficult to effectively perfume a bleaching composition so that the perfume remains stable during storage and is available for effective delivery without being altered or destroyed by the bleach.

Bleaching agents are materials that lighten or whiten a substrate through chemical action and clean substrates, e.g., textiles, by removing soil. This action can involve either oxidative or reductive processes that make color bodies in the substrate more soluble and more easily removed during processing. The color producing agents in fibers are often organic compounds that contain conjugated chains, that is, alternating single and double bonds, called chromophores. Decolorization often can be achieved by destroying one or more of the double bonds in the conjugated systems such as by adding to, or cleaving, the double bond.

Bleaching agents can be classified into three categories: chlorine containing bleaching agents, peroxygen compounds, and reducing bleaches. Three classes of chlorine-containing compounds used as bleaching agents are: chlorine, hypochlorites and N-chloro compounds, and chlorite and chlorine dioxide. The first two classes, termed available-chlorine compounds, produce hypochlorous acid and hypochlorite anion in bleaching baths. Peroxygen or active oxygen compounds contain a peroxide linkage (—O—O—) in which one oxygen atom is active, such as hydrogen peroxide. The reducing agents generally used in bleaching include sulfur dioxide, sulfurous acid, bisulfites, sulfites, hydrosulfites (dithionites), sodium formaldehyde sulfoxylate, and sodium borohydride.

U.S. Pat. No. 4,663,068 (Hagemann et al.) discloses a bleach-stable deodorant perfume stable in the presence of sodium perborate tetrahydrate and N,N,N',N'-tetraacetyl ethylenediamine. Specifically, Hageman et al. discloses a detergent powder product suitable for use in the washing of fabrics which comprises (i) from 5 to 40% by weight of non-soap detergent active compound comprising an anionic detergent active compound; (ii) from 1 to 90% by weight of a non-soap detergency builder; (iii) from 1 to 30% by weight of peroxy bleach compound together with an activator; (iv) from 0.1 to 5% by weight of a bleach-stable perfume which comprises from 50 to 100% by weight of bleach-stable deodorant perfume components having a Lipoxidase-inhibiting capacity of at least 50% or a Raoult variance ratio of at least 1.1. The components are allocated to one of the following six classes: Class 1: phenolic substances; Class 2: essential oils, extracts, resins and synthetic oils; Class 3: aldehydes and ketones; Class 4: nitrogen-containing compounds; Class 5: esters; Class 6: alcohols and ethers. The components are selected so that: (a) the bleach-stable deodorant perfume contains at least five different components; and (b) the bleach-stable deodorant perfume contains components from at least four of the six classes.

U.S. Pat. No. 4,579,677 (Hooper et al.) discloses a deodorant product having a deodorant value of from 0.50 to 3.5 as measured by the Deodorant Value Test. Specifically, Hooper et at. discloses a deodorant product suitable for application to surfaces other than human skin, which product comprises (i) from 0.1 to 50% by weight of a bleaching agent; and (ii) from 0.1 to 20% by weight of a deodorant composition comprising from 45 to 100% by weight of deodorant active components, the components having a Lipoxidase-inhibiting capacity of at least 50% or a Roaoult variance ratio of at least 1.1. The components are classified into the following six classes: Class 1: phenolic substances; Class 2: essential oils, extracts, resins and synthetic oils; Class 3: aldehydes and ketones; Class 4: polycyclic compounds; Class 5: esters; Class 6: alcohols. The components are selected so that (a) the deodorant composition contains at least five components of which at least one must be selected from each of Class 1, Class 2 and Class 4; and (b) the deodorant composition contains components from at least four of the six classes.

SUMMARY OF THE INVENTION

The present invention relates to a shaped fragrant bleaching block and methods for making and employing the block. In general, a fragrant bleaching block is made and employed by admixing an organoleptic effective amount of a fragrant agent with a bleaching agent and the other ingredients of the final desired composition and compression-molding, melt-casting, or extruding the composition to form a block.

The shaped fragrant bleaching block comprises:

(a) a bleaching agent having a reduction potential from about −0.7 v to about +0.4 v compared to an Ag/AgCl electrode; and (b) an organoleptic effective amount of a fragrant agent which (i) is stable to the bleaching agent, (ii) does not decompose the bleaching agent, and (iii) is not substantially hygroscopic.

In a preferred embodiment, the present invention relates to a method of making shaped fragrance bleaching blocks and, in particular, urinal blocks. The shaped fragrance bleaching blocks may be produced, for example, by (a) admixing the bleaching agent and fragrant agent and the other desired components and placing the mixture into a mold of a predetermined size and shape; (b) compressing the mold for a period of time and at a pressure sufficient to produce a solid fragranced bleaching block; and (c) recovering the solid shaped fragranced bleaching block from the mold. Another example of a method for producing the shaped fragranced bleaching blocks of this invention comprises (a) admixing the aforesaid composition and extruding a melt or partial melt of the mixture into a mold of the predetermined size and shape; (b) cooling the mold to solidify the shaped fragranced bleaching block; and (c) recovering the solid shaped fragranced bleaching block from the mold. To achieve a melt or partial melt in accordance with the present invention, the composition mixture is heated for a time sufficient to melt or partially melt the quantity of composition mixture placed in the oil bath.

Methods for cleaning, reducing or retarding bacterial, fungal and algal growth, and controlling biofilm are also provided by this invention. According to the method of this invention, a shaped fragranced bleaching block of this invention is placed in a toilet fixture for a time sufficient to reduce or retard the growth of bacteria, fungus or algae in the toilet fixture. In a preferred embodiment, the growth of bacteria, fungus and algae in a toilet bowl or urinal is reduced or retarded by placing a urinal block in a toilet fixture. The block may be placed in the tank or under the rim of the fixture. As used herein, a toilet fixture includes, for example, toilets and urinals.

DETAILED DESCRIPTION OF THE INVENTION

In accord with the present invention, applicants have discovered that stable, fragrant bleaching compositions can be prepared having improved properties over conventional bleaching compositions. The bleaching compositions comprise a bleaching agent having a reduction potential from about −0.7 v to about +0.4 v compared to an Ag/AgCl electrode, and a fragrant agent which (i) must be stable to the bleaching agent, (ii) must not decompose the bleaching agent, and (iii) must not be hygroscopic. The stable, fragrant bleaching compositions can be prepared using a wide variety of components. This invention also pertains to methods for making and employing the stable, fragrant bleaching compounds.

The following terms are used throughout the specification and are defined as follows unless otherwise indicated.

The term "halogen" as used herein refers to the chemically related elements consisting of chlorine and bromine.

The term "lower-alkyl" as used herein means branched- or unbranched-hydrocarbon radicals containing from 1 to 12 carbon atoms, preferably from 1 to 6 carbon atoms. Non-limiting examples of branched and unbranched lower-alkyl groups having from 1 to 12 carbon atoms are methyl, ethyl, n-propyl, i-propyl, n-butyl, sec-butyl, tert-butyl, n-pentyl, sec-pentyl, tert-pentyl, and the like.

The terms "odor", "fragrance", and "smell" as used herein are used interchangeable whenever a compound is referred to as an organoleptic which is intended to stimulate the sense of smell.

The term "organoleptic" as used herein refers to compounds of the invention which stimulate the sense of smell and are thus perceived as having a characteristic odor.

The term "organoleptic effective amount" as used herein means level or amount of fragrant agent(s) present in a composition at which the incorporated agent(s) exhibit(s) a sensory effect.

The term "not substantially hygroscopic" as used herein refers to a compound, such as a fragrant agent, which does not have the property of adsorbing substantial moisture from the air. The fragrant agents of the present invention which are not substantially hygroscopic and do not adsorb substantial moisture form the air may adsorb up to about 3%, preferably up to about 2%, more preferably up to about 1%, and most preferably up to about 0.5%, by weight.

The term "shaped fragranced bleaching block" as used herein refers to a solid product having a predetermined shape, which is hard, organoleptic, shape-retentive, and dust-free.

The bleaching agents which may be employed in the present invention may be selected from a wide variety of compounds. Suitable bleaching agents which may be employed have a reduction potential from about −0.7 v to about +0.4 v, preferably from about −0.4 v to about +0.2 v, more preferably from about −0.2 v to about +0.1 v, and most preferably about −0.2 v, compared to an Ag/AgCl reference electrode. Preferably, the bleaching agent is selected from the group consisting of chlorine-containing bleaching agents, peroxygen compounds, and reducing bleaches. The chlorine-containing bleaching compounds may be selected from the group consisting of chlorine, hypochlorites and N-chloro compounds, and chlorite and chlorine dioxide.

In a preferred embodiment, the bleaching agent is a halogenated hydantoin (halohydantoin). The structure of some typical halogenated hydantoins is set out below.

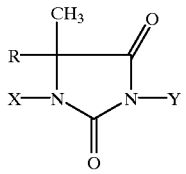

| | X | Y |
|---|---|---|
| 1,3-Dichloro-5,5-dimethylhydantoin (DCDMH) | Cl | Cl |
| 1-Bromo-3-chloro-5,5-dimethylhydantoin (BCDMH) | Br | Cl |
| 1,3-Dibromo-5,5-dimethylhydantoin (DBDMH) | Br | Br |

where R is methyl.

Halogenated hydantoins include, but are not limited to, N-monohalogenated hydantoins such as N-chloro-5,5-dimethylhydantoin (MCDMH) and N-bromo-5,5-dimethylhydantoin (MBDMH), and dihalogenated hydantoins such as 1,3-dichloro-5,5-dimethylhydantoin (DCDMH), 1,3-dibromo-5,5-dimethylhydantoin (DBDMH), and 1-bromo-3-chloro- 5,5-dimethylhydantoin (BCDMH). Halogenated methyl ethylhydantoins may also be employed such as N-chloro-5-methyl-5-ethylhydantoin (MCMEH) 1,3-dichloro-5-methyl-5-ethylhydantoin (DCMEH), N-bromo-5-methyl-5-ethyl-hydantoin (MBMEH), 1,3-dibromo-5-methyl-5-ethylhydantoin (DBMEH), and 1-bromo-3-chloro-5-methyl-5-ethylhydantoin (BCMEH). Alkyl substitution is not limited to methyl and ethyl but also includes lower-alkyl mixtures of $C_1$ to $C_{12}$ isomers. Preferably, the bleaching agent is selected from the group consisting of 1,3-dichloro-5,5-dimethylhydantoin and 1-bromo-3-chloro-5,5-dimethylhydantoin, and more preferably the bleaching agent is 1,3-dichloro-5,5-dimethylhydantoin.

The term "reduction refers to a chemical reaction in which hydrogen combines with another substance or in which oxygen is removed from a substance. More generally, the term "reduction" refers to a chemical change in which the valence state of an atom of an element is decreased as a result of the gain of one or more electrons. The standard hydrogen electrode provides the reference for all oxidation-reduction systems. The hydrogen half-cell or hydrogen electrode is defined as set out below.

$$H^+(aq)+e=\frac{1}{2}H_2\ (g)$$

By definition, the potential of this system is zero $E^0$=0.000V) at all temperatures when an inert metallic electrode dips into a solution of hydrogen ions of unit activity, i.e., pH=0, in equilibrium with hydrogen gas at one atmosphere of pressure. The potential of all other electrodes are then referred to this defined zero. The absolute potential of other electrodes may be either greater or small, and thus may be positive or negative relative to the potential of the standard hydrogen electrode.

The reduction potential of some typical halogenated hydantoins is set out below.

| Halogenated Hydantoin | Cyclic Voltammetry (CV) peak potentials: |
|---|---|
| Bromodimethylhydantoin (MBDMH) | +0.2v |
| Chlorodimethylhydantoin (MCDMH) | −0.7v |
| Dibromodimethylhydantoin (DBDMH) | +0.1v, +0.4v |
| Dichlorodimethylhydantoin (DCDMH) | −0.2v |

Reference literature electrode is Ag/AgCl; Reference literature reports $CL_2$ as +1.36 v and $Br_2$ as +1.08 v.

Other brominated and chlorinated oxidizing materials include, but are not limited to, the alkali metal salts of dihalocyanurates, such as sodium dichloroisocyanurate, trichlorocyanuric acid, various halogenated glycolurils, and halogenated aromatic sulfonamides such as chloramine T, chloramine B, and halogenated sulfamates.

A particularly preferred bleaching agent is Dantochlor® RW, a mixture of 1,3-dichloro-5,5-dimethylhydantoin and 1,3-dichloro-5,5-diethyl-hydantoin. Dantochlor® RW is used as an aid in the control of bacterial, fungal and algal slimes in evaporative condensers, recirculating cooling tower systems, influent systems such as flow through filters, lagoons, industrial wet scrubber systems, and brewery pasteurizers. Dantochlor® RW is also used as an antimicrobial for pulp and for the manufacture of non-food grades of paper and paperboard and for enhanced oil recovery. Dantochlor® RW is a proprietary hydantoin derivative in briquette form and functions as a microbicide through the controlled release of active chlorine.

The fragrant agents which may be employed in the present invention may be selected from a wide variety of compounds. Suitable fragrant agents which may be employed (i) are stable to the bleaching agent, (ii) do not decompose the bleaching agent, and (iii) are not substantially hygroscopic. Fragrant agents which are considered to be stable to the bleaching agent and do not decompose the bleaching agent are those fragrant agents which have an odor value of "C" or better as defined in Table 1. In another embodiment, fragrant agents which are considered to be stable to the bleaching agent and do not decompose the bleaching agent are those fragrant agents which have an odor value of "B" or better as defined in Table 1.

In a preferred embodiment, the fragrant agent (i) is stable to the bleaching agent, (ii) does not decompose the bleaching agent, and (iii) is not substantially hygroscopic, with the proviso that the fragrant agent is not an essential oil, extract, resin, or synthetic oil. In another preferred embodiment, the fragrant agent (i) is stable to the bleaching agent, (ii) does not decompose the bleaching agent, and (iii) is not substantially hygroscopic, with the proviso that the fragrant agent is not a polycyclic compound.

Preferably, the fragrant agent has an odor value of C or better. More preferably, the fragrant agent has an odor value of C or better and is selected from the group consisting of isoamyl phenyl ether (commercially available under the trade name "Anther" from PPF Norda, East Hanover, N.J.), isoborneol, isoborneol methyl ether, 2,2-dimethylbicyclo [2.2.1]-heptane-3-carboxylic acid, methyl ester (commercially available under the trade name "Cistulate" from Naarden International, New York, N.Y.), 2-tertiary pentyl cyclohexanyl acetate (commercially available under the trade name "Coniferan" from International Fragrances & Flavors, Union Beach, N.J.), 7-octen-2-ol-2,6-dimethyl acetate (commercially available under the trade name "Dihydro Myrcenyl Acetate" from Quest International Fragrances Company, Mount Olive, N.J.), 1-methyl-4-isopropyl cyclohexan-8-yl acetate (commercially available under the trade name "Dihydro Terpinyl Acetate" from International Fragrances & Flavors, Union Beach, N.J.), tetrahydrogeraniol, 2,6-dimethylheptan-2-ol (commercially available under the trade name "Dimetol" from Givaudan, Clifton, N.J.), diphenyl methane (commercially available from Elan Chemical Company Incorporated, Newark, N.J.), diphenyl oxide diphenyl ether (commercially available from Polarome Manufacturing Company, Incorporated, Jersey City, N.J.), eucalyptol (commercially available from Ungerer & Company, Lincoln Park, N.J.), alpha-fenchyl acetate (commercially available from Citrus & Allied Essences Ltd., Floral Park, N.J.), 1,3-dioxane-2,4,6-trimethyl-4-phenyl (commercially available under the trade name "Floropal" from Haarmann & Reimer Corp., Springfield, N.J.), 4-methyl-2-(2-methylpropyl)tetrahydro-2H-pyran-4-ol (commercially available under the trade name "Florosa (Q)" from Quest International Fragrances Company, Mount Olive, N.J.), ethyl tricyclo-[5.2.1.02,6] decan-2-carboxylate (commercially available under the trade name "Fruitate" from KAO Corporation, Tokyo, Japan). 2-methyldecanonitrile (commercially available under the trade name "Frutonile" from Quest International Fragrances Company, Mount Olive, N.J.), 2-butyl-4,4,6-trimethyl-1,3-dioxane (commercially available under the trade name "Herboxane" from Quest International Fragrances Company, Mount Olive, N.J.), 2-butyl-4,4,6-trimethyl-1,3-dioxane (commercially available from Roure Betrand Dupont, Inc., Teaneck, N.J.), limetol (commercially available from Quest International Fragrances Company, Mount Olive N.J.), 3,12-tridecadiene nitrile (commercially available under the trade name "Mandaril" from Haarmann & Reimer Corp., Springfield, N.J.), methyl lavender ketone (commercially available from International Fragrances & Flavors, Union Beach, N.J.), octanal dimethyl acetal (commercially available under the trade name "Octacetal" from International Fragrances & Flavors, Union Beach, N.J.), orange flower ether (commercially available from International Fragrances & Flavors, Union Beach, N.J.), p-tertiary butyl cyclohexanol (commercially available under the trade name "Patchone" from International Fragrances & Flavors, Union Beach, N.J.), benzene pentanol, gamma-methyl (commercially available under the trade name "Phenoxanol" from International Fragrances & Flavors, Union Beach, N.J.), 3-octanol (commercially available under the trade name "Tetrahydroalloocimenol" from Union Camp Corporation, Jacksonville, Fla.), 3,7-dimethyl-3-octanol (commercially available under the trade name "Tetrahydro-linalool" from Givaudan, Clifton, N.J.), 2,6dimethyl-2-octanol (commercially available under the trade name "Tetrahydromyrcenol" from SCM Glidco Organics Corp., Jacksonville, Fla.), thymyl methyl ether, ortho-tertiary butyl cyclohexanyl acetate (commercially available under the trade name "Verdox" from International Fragrances & Flavors, Union Beach, N.J.), benzene, 2-(1-ethoxyethoxy) ethyl-1-ethoxy-1-(2-phenyl-ethoxy)ethane (commercially available under the trade name "Vertocinth" from Bush Boake Allen Inc., Montvale, N.J.), cyclohexyl phenyl ethyl ether (commercially available under the trade name "Phenafleur" from International Fragrances & Flavors, Union Beach, N.J.), 1-(4isopropylcyclohexyl)ethanol (commercially available under the trade name "Mugetanol" from Haarmann & Reimer Corp., Springfield, N.J.), and bicyclo[2.2.1]heptane-2-ethyl-5(or 6)-methoxytricyclo [2.2.1.0.2.6]heptane, 1-ethyl-3-methoxy (commercially available under the trade name "Neoproxen" from International Fragrances & Flavors, Union Beach, N.J.).

More preferably, the fragrant agent comprises a mixture of two members selected from the group consisting of isoamyl phenyl ether, isoborneol, isoborneol methyl ether, 2,2-dimethylbicyclo[2.2.1]heptane-3-carboxylic acid, methyl ester, 2-tertiary pentyl cyclohexanyl acetate, 7-octen-2-ol-2,6-dimethyl acetate, 1-methyl-4-isopropyl cyclohexan-8-yl acetate, tetrahydrogeraniol, 2,6dimethylheptan-2-ol, diphenyl methane, diphenyl oxide, eucalyptol, alpha-fenchyl acetate, 1,3-dioxane-2,4,6-trimethyl-4-phenyl, 4-methyl-2-(2-methylpropyl) tetrahydro-2H-pyran-4-ol, ethyl tricyclo-[5.2.1.02,6]decan-2-carboxylate, 2-methyldecanonitrile, 2-butyl-4,4,6-trimethyl-1,3-dioxane, 2-butyl-4,4,6-trimethyl-1,3-dioxane, limetol, 3,12-tridecadiene nitrile, methyl lavender ketone, octanal dimethyl acetal, orange flower ether, p-tertiary butyl cyclohexanol, benzene pentanol, gamma-methyl, 3-octanol, 3,7-dimethyl-3-octanol, 2,6-dimethyl-2-octanol, thymyl methyl ether, ortho-terdary butyl cyclohexanyl acetate, benzene, 2-(1-ethoxy-ethoxy) ethyl-1-ethoxy-1-(2-phenylethoxy)ethane, cyclohexyl phenyl ethyl ether, 1-(4isopropylcyclohexyl)ethanol, and bicyclo[2.2.1]heptane-2-ethyl-5(or 6)-methoxytricyclo[2.2.1.0.2.6] heptane, 1-ethyl-3-methoxy, wherein at least one member has an odor value of C or better.

Most preferably, the fragrant agent comprises a mixture of three members selected from the group consisting of isoamyl phenyl ether, isoborneol, isoborneol methyl ether, 2,2-dimethylbicyclo[2.2.1]heptane-3-carboxylic acid, methyl ester, 2-tertiary pentyl cyclohexanyl acetate, 7-octen-2-ol-2,6-dimethyl acetate, 1-methyl-4-isopropyl cyclohexan-8-yl acetate, tetrahydrogeraniol, 2,6-dimethylheptan-2-ol, diphenyl methane, diphenyl oxide, eucalyptol, alpha-fenchyl acetate, 1,3-dioxane-2,4,6-trimethyl-4-phenyl, 4methyl-2-(2-methylpropyl)tetrahydro-2H-pyran4-ol, ethyl tricyclo-[5.2.1.02,6]decan-2-carboxylate, 2-methyldecanonitrile, 2-butyl-4,4,6-trimethyl-1,3-dioxane, 2-butyl-4,4,6-trimethyl-1,3-dioxane, limetol, 3,12-tridecadiene nitrile, methyl lavender ketone, octanal dimethyl acetal, orange flower ether, p-tertiary butyl cyclohexanol, benzene pentanol, gamma-methyl, 3-octanol, 3,7-dimethyl-3-octanol, 2,6-dimethyl-2-octanol, thymyl methyl ether, ortho-tertiary butyl cyclohexanyl acetate, benzene, 2-(1-ethoxy-ethoxy) ethyl-1-ethoxy-1-(2-phenylethoxy)ethane, cyclohexyl phenyl ethyl ether, 1-(4-isopropylcyclohexyl)ethanol, and bicyclo[2.2.1]heptane-2-ethyl-5(or 6)-methoxytricyclo[2.2.1.0.2.6]heptane, 1-ethyl-3-methoxy, wherein at least one member has an odor value of C or better.

In a preferred embodiment, the fragrant agent has an odor value of B or better. More preferably, the fragrant agent has an odor value of B or better and is selected from the group consisting of isoamyl phenyl ether, isoborneol, isoborneol methyl ether, 2,2-dimethylbicyclo[2.2.1]heptane-3-carboxylic acid, methyl ester, 2-tertiary pentyl cyclohexanyl acetate, 7-octen-2-ol-2,6-dimethyl acetate, 1-methyl-4-isopropyl cyclohexan-8-yl acetate, tetrahydrogeraniol, 2,6-dimethylheptan-2-ol, diphenyl methane, diphenyl oxide, eucalyptol, alpha-fenchyl acetate, 1,3-dioxane-2,4,6-trimethyl-4-phenyl, 4-methyl-2-(2-methylpropyl) tetrahydro-2H-pyran-4-ol, ethyl tricyclo-[5.2.1.02,6] decan-2 carboxylate, 2-methyldecanonitrile, 2-butyl-4,4,6-trimethyl-1,3-dioxane, 2-butyl4,4,6-trimethyl-1,3-dioxane, limetol, 3,12-tridecadiene nitrile, methyl lavender ketone, octanal dimethyl acetal, orange flower ether, p-tertiary butyl cyclohexanol, benzene pentanol, gamma-methyl, 3-octanol, 3,7-dimethyl-3-octanol, 2,6-dimethyl-2-octanol, thymyl methyl ether, ortho-tertiary butyl cyclohexanyl acetate, benzene, 2-(1-ethoxy-ethoxy) ethyl-1-ethoxy-1-(2-phenylethoxy)ethane, cyclohexyl phenyl ethyl ether, 1-(4-isopropylcyclohexyl)ethanol, and bicyclo[2.2. 1]heptane-2-ethyl-5(or 6)-methoxytricyclo[2.2.1.0.2.6]heptane, 1-ethyl-3-methoxy.

The fragrant agent may also comprise a diluent. Suitable diluents may be selected from the group consisting of Isopar L (light), Isopar M (medium), and Isopar H (heavy). Preferably, the diluent is Isopar M. Isopar L, Isopar M, and Isopar H are clear, colorless, liquid, synthetic, isoparaffinic hydrocarbons which are commercially available from Exxon Chemical Company, Houston, Tex.

In a preferred embodiment, the fragrant agent comprises a mixture (No. 1) of the following components in the proportions set out below:

| Ingredient Name | Quantity |
|---|---|
| 2,2-Dimethylbicyclo[2.2.1]heptane-3-carboxylic acid, methyl ester | 2 |
| 7-Octen-2-ol-2,6-dimethyl acetate | 100 |
| 1-Methyl-4-isopropyl cyclohexan-8-yl acetate | 300 |
| 2,6-Dimethylheptan-2-ol | 30 |
| Diphenyl oxide | 10 |
| Eucalyptol | 50 |
| alpha-Fenchyl acetate | 50 |
| 4-Methyl-2-(2-methylpropyl)tetrahydro-2H-pyran-4-ol | 25 |
| Ethyl tricyclo[5.2.1.02,6]decan-2-carboxylate | 2.5 |
| 2-Butyl-4,4,6-trimethyl-1,3-dioxane | 50 |
| Isoborneol | 3.5 |
| Isoborneol methyl ether | 25 |
| Isopar M | 50 |
| Methyl lavender ketone | 5 |
| Octanal dimethyl acetal | 7 |
| Tetrahydrogeraniol | 30 |
| 3,7-Dimethyl-3-octanol | 200 |
| ortho-Tertiary butyl cyclohexanyl acetate | 60 |
| Total | 1000 |

In another preferred embodiment, the fragrant agent comprises a mixture (No. 2) of the following components in the proportions set out below:

| Ingredient Name | Quantity |
|---|---|
| 7-Octen-2-ol-2,6-dimethyl acetate | 150 |
| 1-Methyl-4-isopropyl cyclohexan-8-yl acetate | 150 |
| Tetrahydrogeraniol, 2,6-dimethylheptan-2-ol | 150 |
| Diphenyl oxide | 15 |

-continued

| Ingredient Name | Quantity |
|---|---|
| 1,3-Dioxane-2,4,6-trimethyl-4-phenyl | 25 |
| Ethyl tricyclo[5.2.1.02,6]decan-2-carboxylate | 18 |
| Limetol | 10 |
| Octanal dimethyl acetal | 10 |
| 2,6-Dimethyl-2-octanol | 400 |
| Thymyl methyl ether | 2 |
| ortho-Tertiary butyl cyclohexanyl acetate | 70 |
| Total | 1000 |

In another preferred embodiment, the fragrant agent comprises a mixture (No. 3) of the following components in the proportions set out below:

| Ingredient Name | Quantity |
|---|---|
| Isoamyl phenyl ether | 15 |
| 2,2-Dimethylbicyclo[2.2.1]heptane-3-carboxylic acid, methyl ester | 5 |
| 2-Tertiary pentyl cyclohexanyl acetate | 25 |
| 7-Octen-2-ol-2,6-dimethyl acetate | 400 |
| Diphenyl methane | 15 |
| Eucalyptol | 15 |
| alpha-Fenchyl acetate | 100 |
| Isoborneol methyl ether | 200 |
| 3,7-Dimethyl-3-octanol | 150 |
| ortho-Tertiary butyl cyclohexanyl acetate | 65 |
| 2-(1-Ethoxyethoxy)ethyl-1-ethoxy-1-(2-phenylethoxy)ethane | 10 |
| Total | 1000 |

In another preferred embodiment, the fragrant agent comprises a mixture (No. 4) of the following components in the proportions set out below:

| Ingredient Name | Quantity |
|---|---|
| Diphenyl methane | 350 |
| Eucalyptol | 450 |
| Ethyl tricyclo[5.2.1.02,6]decan-2-carboxylate | 25 |
| Isopar M | 115 |
| Octanal dimethyl acetal | 25 |
| Tetrahydrogeraniol | 35 |
| Total | 1000 |

The amount of fragrant agent present in the stable fragrant bleaching compositions of the present invention is an organoleptic effective amount. An organoleptic effective amount of fragrant agent is that amount of fragrant agent necessary to exhibit a sensory effect and thereby mask or odor-modify the bleaching agent in the bleaching composition. The exact amount of fragrant agent is a matter of preference subject to such factors as the type of fragrant agent and bleaching agent employed as well as the other ingredients present in the bleaching composition. In a preferred embodiment, the fragrant agent is present in the stable fragrant bleaching compositions in an amount from about 1% to about 10%, preferably from about 2% to about 8%, more preferably from about 4% to about 6%, and most preferably about 5%, by weight of the stable, fragrant bleaching composition.

In a preferred embodiment, the present invention is directed to shaped fragrance bleaching blocks. In particular, a fragranced urinal block is provided by this invention. The shaped fragranced bleaching blocks comprise a bleaching agent having a reduction potential from about −0.7 v to about +0.4 v compared to an Ag/AgCl reference electrode, an organoleptic effective amount of a fragrant agent which (i) is stable to the bleaching agent, (ii) does not decompose the bleaching agent, and (iii) is not substantially hygroscopic, and at least one of the following additives: a solubility modifier, a compaction aid, a filler, a surfactant, a dye, a dispersant, a binder, a lubricant/mold release agent, a detergent builder, a corrosion inhibitor, a chelant, a stabilizer, a biocide, a bromide source, and an oxidizing halogenated biocide. In a more preferred embodiment, the shaped fragranced bleaching block contains a bleaching agent composition containing chlorinated hydantoins and combinations thereof. For example, the shaped fragranced bleaching block may contain approximately eighty percent 1,3-dichloro-5,5-dimethylhydantoin and twenty percent 1,3-dichloro-5,5-methylethylhydantoin ("Dantochlor®"), and the binder ethylene-bis-stearamide ("Acrawax® C").

Once prepared, the inventive stable fragrant bleaching compositions may be stored for future use or may be formulated in effective amounts with acceptable carriers to prepare a wide variety of fragrant compositions. Suitable carriers include sodium sulfate and the like. Other ingredients will usually be incorporated into the composition as dictated by the nature of the desired composition as well known by those having ordinary skill in the art. The ultimate bleaching compositions are readily prepared using methods generally known in the chemical arts. Illustrative non-limiting additive categories and examples of formulating materials that may be employed in the stable fragrant bleaching compositions of the present invention include solubility modifiers (for example, sodium bicarbonate, aluminum hydroxide, magnesium oxide, barium hydroxide and sodium carbonate; see U.S. Pat. No. 4,537,697); compaction aids (for example, inorganic salts comprised of hydrogen, lithium, sodium, potassium, magnesium and calcium cations associated with carbonate, bicarbonate, borate, silicate, phosphate, percarbonate, and perphosphate; see U.S. Pat. No. 4,677,130); fillers (for example, inorganic salts such as combinations of lithium, sodium, potassium, magnesium and calcium cations with sulfate and chloride anions as well as other inorganics such as clays and zeolites); surfactants (for example, sodium dioctyl sulfosuccinate, disodium lauryl sulfosuccinate, sodium lauryl sulfoacetate and sodium cocoylisothionate); dyes (for example, copper phthalocyanine tetrasulfonic acid tetra sodium salt dye, derivitized and underivitized phthalocyanines such as Pigment Green 7, Pigment Blue 15, and Pigment Blue 86 as well as inorganic pigments such as lazurite); fragrances (for example, BBA—Pine Herbal); dispersants (for example, polyacrylic acid and secondary and tertiary polymers of the polyacrylic acid based dispersants and 2-phosphono-1,2,4-butanetricarboxylic acid tetra-Na salt, "Bayhibit®0 S"); lubricants/mold release agents (for example, magnesium, calcium, and sodium stearate); binders (for example, ethylene-bis-stearamide, "Acrawax® C"); chelants (for example, sodium gluconate, ethylene diamine tetraacetic acid (EDTA), citric acid and sodium nitrilotriacetate (NTA)); stabilizers (for example, dimethyl hydantoin, N-hydrogen stabilizers such as 5,5-dimethyl hydantoin (DMI), 5,5-ethylmethyl hydantoin (EMH), cyanuric acid, sulfamic acid, urea, 4,4-dimethyl-2-oxazolidinome, sulfonamides (for example, benzene sulfonamide, p-toluene sulfonamide, and methane sulfonamide), sulfamates, glycoluril and succinimide), biocides (for example, copper sulfate, molybdates, selenates, tungstates, and chromates; see U.S. Pat. No. 4,995,987); bromide sources (for example, sodium bromide and potassium bromide); corrosion inhibitors (for example, sodium silicate and sodium benzoate); and oxidizing halogenated biocides (for example, bromochlor-5,5-dimethylhydantoin (BCDMH), halogenated hydantoins, chlorinated isocyanurates and other halogenated n-hydrogen compounds).

The present invention is further illustrated by the following examples, which are not intended to limit the effective scope of the claims. All parts and percentages in the examples and throughout the specification and claims are by weight of the final composition unless otherwise specified.

EXAMPLE I

This example illustrates a method for preparing a solid, stable, fragrant bleaching composition in tablet form containing a fragrant agent and a bleaching agent compound according to the present invention.

The formula for making a tablet of solid, stable, fragrant bleaching composition for testing is set out below:

| Component | % by weight |
|---|---|
| 1. Precipitated silica | 2.00 |
| 2. Fragrance | 5.00 |
| 3. Dioctyl sodium sulfosuccinate | 4.00 |
| 4. Sodium sulfate | 4.00 |
| 5. Bleaching agent | 85.00 |
| Total | 100.00 |

All work preparing the solid, stable, fragrant bleaching composition was performed in a ventilating hood using protective gloves, a dust mask, and goggles. Components #1 and #2 were pre-mixed until a dry powder was formed. Components #3 through #5 were then added in order and mixed until uniform. A quantity of 10 grams of the above mixture was placed in a chrome-plated die set and then placed in a Carver Press where 20,000 psi was applied for 5 seconds. The pressure was relieved by loosening the hydraulic bleed valve. The tablet was then removed from the die by inverting the die and placing a flange between the die and the press. The press was pumped until the tablet was released. The pressure was again released by loosing the hydraulic bleed valve and removing the die and tablet. One 10 gm tablet was then placed in 500 ml of tap water and the odor was evaluated as described below.

A number of fragrances materials were tested in a block tablet, prepared as described above, at a 5.00% level, by weight, employing Dantochlor® RW powder as the bleaching agent. Table 1, set out below, summarizes the results of the odor and color observations of the tablets after storage for two weeks, at room temperature and at 110° F.

TABLE 1

| | 2 weeks Room Temperature | | 2 weeks 110° F. | |
|---|---|---|---|---|
| Component | Color | Odor | Color | Odor |
| No fragrance | 0 | A | 0 | B |
| Anther | 0 | B | 0 | C |
| Isoborneol | 0 | A | O/+ | B |
| Isoborneol methyl ether | 0 | A/B | + | B |
| Cistulate | 0 | B | 0/+ | B/C |
| Coniferan | 0 | B | 0/+ | C |
| Dihydro myrenyl acetate | 0 | B | 0/ + | D |
| Dihydro terpinyl acetate | 0 | B | ++ | D |
| Tetrahydrogeraniol | 0 | A/B | 0/+ | B |
| Dimetol | 0 | A | 0/+ | C |
| Diphenyl methane | 0 | A | 0/+ | B |
| Diphenyl oxide | ++ | B | +++ | C |

TABLE 1-continued

| | 2 weeks Room Temperature | | 2 weeks 110° F. | |
|---|---|---|---|---|
| Component | Color | Odor | Color | Odor |
| Eucalyptol (1,8-cineole) | 0 | A | 0 | B |
| Fenchyl acetate, alpha | 0 | A | 0 | C |
| Floropal | 0 | C | ++ | D |
| Florosa (QST-120) | 0 | B | + | C |
| Fruitate | 0 | A | 0/+ | B |
| Frutonile (QST-20) | 0 | A | ++ | C |
| Herboxane | 0 | B | ++ | D |
| Limetol (LRG 1182) | 0 | B | 0 | D |
| Mandaril | 0 | B | 0/+ | D |
| Methyl lavender ketone | 0 | B | 0/+ | D |
| Octacetal | 0 | A | 0 | B |
| Orange flower ether | 0 | B/C | 0 | D |
| Isopar M | 0 | A | 0 | A/B |
| Patchone | ++++ | N/S | N/S | N/S |
| Phenoxanol | + | C | ++ | D |
| Tetrahydro allo ocimenol | 0 | A/B | 0/+ | D |
| Tetrahydro linalool | 0 | B | 0/+ | 0 |
| Tetrahydro myrcenol | 0 | A/B | 0/+ | D |
| Thymyl methyl ether | ++ | B | +++ | C |
| Verdox | 0 | B | 0 | C |
| Vertocinth (efetaal) | 0 | B | + | D |
| Phenafleur (IFF-121) | + | B | + | D |
| Mugetanol (HNR-50) | ++++ | N/S | N/S | N/S |
| Neoproxen (IFF-149) | 0 | B | 0/+ | 0 |

Color Stability
++++ = Severe intense discoloration
+++ = Considerable discoloration
++ = Moderate discoloration
+ = Slight discoloration
0 = Essentially no color change relative to unfragranced base
Odor Stability
A = Stable
B = Acceptably stable, slight change
C = Less stable, not disagreeable
D = Unstable, "off" note
N/S = No sample due to reaction at room temperature Based on the observations set out in Table 1, fragrance mixtures Nos. 1 through 4 were prepared with the components, and in the proportions, set out below.

Fragrance Mixture No. 1, Lavanda Verde

| Ingredient Name | Quantity |
|---|---|
| 2,2-Dimethylbicyclo[2.2.1]heptane-3-carboxylic acid, methyl ester | 2 |
| 7-Octen-2-ol-2,6-dimethyl acetate | 100 |
| 1-Methyl-4-isopropyl cyclohexan-8-yl acetate | 300 |
| 2,6-Dimethylheptan-2-ol | 30 |
| Diphenyl oxide | 10 |
| Eucalyptol | 50 |
| alpha-Fenchyl acetate | 50 |
| 4-Methyl-2-(2-methylpropyl)tetrahydro-2H-pyran-4-ol | 25 |
| Ethyl tricyclo[5.2.1.02,6]decan-2-carboxylate | 2.5 |
| 2-Butyl-4,4,6-dimethyl-1,3-dioxane | 50 |
| Isoborneol | 3.5 |
| Isoborneol methyl ether | 25 |
| Isopar M | 50 |
| Methyl lavender ketone | 5 |
| Octanal dimethyl acetal | 7 |
| Tetrahydrogeraniol | 30 |
| 3,7-Dimethyl-3-octanol | 200 |
| ortho-Tertiary butyl cyclohexanyl acetate | 60 |
| Total | 1000 |

Fragrance Mixture No. 2, Herbal Citrus Bouquet

| Ingredient Name | Quantity |
|---|---|
| 7-Octen-2-ol-2,6-dimethyl acetate | 150 |
| 1-Methyl-4-isopropyl cyclohexan-8-yl acetate | 150 |
| Tetrahydrogeraniol, 2,6-dimethylheptan-2-ol | 150 |
| Diphenyl oxide | 15 |
| 1,3-Dioxane-2,4,6-trimethyl-4-phenyl | 25 |
| Ethyl tricyclo[5.2.1.02,6]decan-2-carboxylate | 18 |
| Limetol | 10 |
| Octanal dimethyl acetal | 10 |
| 2,6-Dimethyl-2-octanol | 400 |
| Thymyl methyl ether | 2 |
| ortho-Tertiary butyl cyclohexanyl acetate | 70 |
| Total | 1000 |

Fragrance Mixture No. 3, Herbal Pine Bouquet

| Ingredient Name | Quantity |
|---|---|
| Isoamyl phenyl ether | 15 |
| 2,2-Dimethylbicyclo[2.2.1]heptane-3-carboxylic acid, methyl ester | 5 |
| 2-tertiary pentyl cyclohexanyl acetate | 25 |
| 7-Octen-2-ol-2,6-dimethyl acetate | 400 |
| Diphenyl methane | 15 |
| Eucalyptol | 15 |
| alpha-Fenchyl acetate | 100 |
| Isoborneol methyl ether | 200 |
| 3,7-Dimethyl-3-octanol | 150 |
| ortho-Tertiary butyl cyclohexanyl acetate | 65 |
| 2-(1-Ethoxyethoxy)ethyl-1-ethoxy-1-(2-phenylethoxy)ethane | 10 |
| Total | 1000 |

Fragrance Mixture No. 4, Lavender Bouquet

| Ingredient Name | Quantity |
|---|---|
| Diphenyl methane | 350 |
| Eucalyptol | 450 |
| Ethyl tricyclo[5.2.1.02,6]decan-2-carboxylate | 25 |
| Isopar M | 115 |
| Octanal dimethyl acetal | 25 |
| Tetrahydrogeraniol | 35 |
| Total | 1000 |

Fragrance mixtures Nos. 1 through 4 were tested in a block tablet, prepared as described above, at a 5.00% level, by weight, employing Dantochlor® RW powder as the bleaching agent. Table 2, set out below, summarizes the results of the odor and color observations of the tablets after storage for two weeks, at room temperature and at 110° F.

TABLE 2

| | 2 weeks Room Temperature | | 2 weeks 110° F. | |
|---|---|---|---|---|
| Component | Color | Odor | Color | Odor |
| No fragrance | 0 | A | 0 | B |
| Mixture 1 | 0 | B | + | C |
| Mixture 2 | 0 | A | 0 | B |
| Mixture 3 | 0 | A | 0 | C |
| Mixture 4 | 0 | A | 0 | B |

TABLE 2-continued

| | 2 weeks Room Temperature | | 2 weeks 110° F. | |
|---|---|---|---|---|
| Component | Color | Odor | Color | Odor |

Color Stability
++++ = Severe intense discoloration
+++ = Considerable discoloration
++ = Moderate discoloration
+ = Slight discoloration
0 = Essentially no color change relative to unfragranced base
Odor Stability
A = Stable
B = Acceptably stable, slight change
C = Less stable, not disagreeable
D = Unstable, "off" note When 1,3-dibromo-5,5-dimethylhydantoin was substituted for 1,3-dichloro-5,5-dimethylhydantoin, the results of the stability testing showed that a fragrant mixture of eucalyptol/fenchyl acetate was relatively stable at room temperature but lost some of its piney odor character at 90° F., although it was still recognizable as a pine-note. A slightly yellow discoloration was also noted. At 100° F. and 110° F., the piney odor completely disappeared and the 1,3-dibromo-5,5-dimethylhydantoin tablets showed a strong yellow discoloration.

EXAMPLE II

This example illustrates a method of preparing a solid block using melt techniques. Several blocks were produced containing various additives including: solubility modifiers, fillers, surfactants, dyes, fragrances, dispersants, lubricants/mold release agents, detergent builder, corrosion inhibitor, chelants, stabilizers, and biocides.

The blocks were produced by admixing the bleaching agent (90%) and the additive (10%) or fragrant agent (10%) and placing the mixture into a test tube and heating in an oil bath having a temperature ranging from 85° to 95° C. The bleaching agents tested consisted of two compositions, identified as Composition A and Composition B in Table 3. Composition A contains a 50/50 mixture of methylethylhydantoin and dimethylhydantoin, which is an all chlorine halohydantoin. Composition B contains a 50/50 mixture of methylethylhydantoin and dimethylhydantoin, which is a 3:1 chlorine to bromine halohydantoin. The mixture was heated until it melted. Upon melting, the mixture was poured into a small hexagonal plastic mold and allowed to cool. The solid block was removed from the mold. Criteria for successful blocks were no visual discoloration and the production of a solid, dust-free form.

All of the additives tested produced solid, dust-free blocks with no visible discoloration. Such blocks would be useful as urinal blocks. The additives tested are set forth in Table 3:

TABLE 3

| Melt Cast Compositions | | |
|---|---|---|
| Halohydantoin | Additive Category | Additive Example |
| Comp. A | Solubility modifier | Aluminum hydroxide |
| Comp. A | Compaction aids | Sodium bicarbonate |
| Comp. A | Filler | Sodium sulfate |
| Comp. A | Surfactant | Sodium dioctyl sulfosuccinate |

TABLE 3-continued

| Melt Cast Compositions | | |
|---|---|---|
| Halohydantoin | Additive Category | Additive Example |
| | | "Aerosol ™ OTB" |
| Comp. A | Dye | Sulfonated copper phthalocyanine |
| Comp. A | Fragrance | BBA - Pine Herbal |
| Comp. A | Dispersant | Polyacrylic acid |
| Comp. A | Dispersant | Phosphonobutane-tricarboxylic acid "Bayhibit ™ S" |
| Comp. A | Binder | Ethylene-bis-stearamide "Acrawax ® C" |
| Comp. A | Detergent builder | Sodium tripolyphosphate |
| Comp. A | Corrosion inhibitor | Sodium silicate |
| Comp. A | Corrosion inhibitor | Sodium benzoate |
| Comp. A | Chelant | Sodium gluconate |
| Comp. A | Stabilizer | Dimethyl hydantoin |
| Comp. A | Biocide | Copper sulfate |
| Comp. A | Bromide source | Sodium bromide |
| Comp. A | Oxidizing halogen composition | BCDMH |
| Comp. B | Solubility modifier | Aluminum hydroxide |
| Comp. B | Filler | Sodium sulfate |
| Comp. B | Dispersant | Polyacrylic acid |

EXAMPLE III

This example illustrates a method of preparing a urinal block containing a fragrant agent, a bleaching agent and at least one additive using compression techniques.

The formula for making a tablet of solid, stable, fragrant bleaching composition for testing is set out below:

| Component | % By Weight |
|---|---|
| Bleaching agent | 85.00 |
| Fragrance (BBA-Pine or Citric/Herbal) | 5.00 |
| Binder (Ethylene-bis-stearamide) | 10.00 |
| TOTAL | 100.00 |

The bleaching agent contained approximately eighty percent 1,3-dichloro-5,5-dimethylhydantoin and twenty percent 1,3-dichloro-5,5-methylethylhydantoin. All work preparing the solid, stable, fragrant bleaching composition was performed in a ventilating hood using protective gloves, a dust mask, and goggles. All of the components were mixed together until uniform. A quantity of 50 grams of the above mixture was placed in a chrome plated die set and then placed in a Carver Press where approximately 18,000 psi to approximately 22,000 psi was applied for approximately 5 to 10 seconds. The pressure was relieved by loosening the hydraulic bleed valve. The tablet was then removed from the die by inverting the die and placing a flange between the die and the press. The press was pumped until the tablet was released. The pressure was again released by loosening the hydraulic bleed valve and removing the die and tablet.

The longevity of each urinal block was tested by placing the urinal block (weighing approximately 50 g) in 500 ml of tap water for a specific period of time each day for three consecutive days. On Day 1, the urinal block was initially weighed and then placed in water for 7 hours. The urinal block was weighed to determine the percentage of block dissolved. On Day 2, the urinal block was again placed in water for 7 hours and then subsequently weighed. On Day 3, the test was run for 8 hours. The results of the three day trial revealed that approximately 8% of the urinal block was dissolved during each experiment. These results demonstrate that after three days, approximately 75% of the urinal block was intact.

Next, the longevity of the urinal block was compared with the longevity of a commercial urinal block. The experiment was conducted in actual working urinals over a two week period of time. The bleaching agent in the commercial urinal block was paradichlorobenzene. The results are illustrated in the table below.

| | Invention | Commercial |
|---|---|---|
| Initial wt. | 84.64 g | 83.63 g |
| Weight after 1 week | 71.64 g | 40.90 g |
| % wt. loss after 1 week | 15% | 51% |
| Weight after 2 weeks | 52.81 g | 2.65 g |
| % wt. loss after 2 weeks | 38% | 97% |

As illustrated above, the commercial urinal block dissolved almost completely within 2 weeks while only 38% of the urinal block of the present invention dissolved within 2 weeks. Thus, the urinal blocks produced by the present invention have a significantly greater longevity compared to commercial urinal blocks.

The invention being thus described, it will be obvious that the same may be varied in many ways. Such variations are not to be regarded as a departure from the spirit and scope of the invention and all such modifications are intended to be included within the scope of the following claims.

I claim:

1. A method for the production of a shaped fragranced bleaching block containing:

(a) a halogenated hydantoin having a reduction potential from about −0.7 v to about +0.4 v compared to an Ag/AgCl reference electrode:

(b) an organoleptic effective amount of a fragrant agent which;

(i) is stable to the bleaching agent;

(ii) does not decompose the bleaching agent;

(iii) is not substantially hygroscopic;

wherein said fragrant agent comprises at least one compound selected from the group consisting of isoamyl phenyl ether, isoborneol, isoborneol methyl ether, 2,2-dimethylbicyclo[2.2.1]heptane-3-carboxylic acid, methyl ester, 2-tertiary pentyl cyclohexanyl acetate, 7-octen-2-ol-2,6-dimethyl acetate, 1-methyl-4-isopropyl cyclohexan-8-yl acetate, tetrahydrogeraniol, 2,6-dimethylheptan-2-ol, diphenyl methane, diphenyl oxide, eucalyptol, alpha-fenchyl acetate, 1,3-dioxane-2,4,6-trimethyl-4-phenyl, 4-methyl-2-(2-methylpropyl) tetrahydro-2H-pyran-4-ol, ethyl tricyclo[5.2.1.02,6] decan-2-carboxylate, 2-methyldecanonitrile, 2-butyl-4, 4,6-trimethyl-1,3-dioxane, 2-butyl-4,4,6-trimethyl-1,3-dioxane, limetol, 3,12-tridecadine nitrile, methyl lavender ketone, octanal dimethyl acetal, orange flower ether, p-tertiary butyl cyclohexanol, benzene pentanol, gammamethyl, 3-octanol, 3,7-dimethyl-3-octanol, 2,6-dimethyl-2-octanol, thymyl methyl ether, ortho-tertiary butyl cyclohexanyl acetate, benzene, 2-(1-ethoxyethoxy) ethyl-1-ethoxy-1-(2-phenylethoxy) ethane, cyclohexyl phenyl ethyl ether, 1-(4-isopropylcyclohexyl)ethanol, and bicyclo[2.2.1] heptane-2-ethyl-5(or 6)-methoxytricyclo[2.2.1.0.2.6] heptane, 1-ethyl-3-methoxy; and (c) at least one of the following additives: a solubility modifier, a compaction aid, a filler, a surfactant, a dye, a dispersant, a binder, a lubricant/mold release agent, a detergent builder, a corrosion inhibitor, a chelant, a stabilizer, a biocide, a bromide source and an oxidizing halogenated biocide, said method comprising the steps of (i) admixing the bleaching agent, the fragrant agent and the additive to form a mixture, (ii) extruding a melt or partial melt of the mixture into a mold of a predetermined size and shape, cooling the mold to solidify the shaped fragranced bleaching block, or placing the mixture into the mold and compressing the mold for a period of time at a pressure sufficient to produce a solid shaped fragranced bleaching block; and (iii) recovering the solid shaped fragranced bleaching block from the mold.

2. A method for reducing or retarding bacterial, fungal and algal growth and controlling biofilm comprising placing a shaped fragranced bleaching block in an environment supportive of bacterial, fungal, or algal growth, containing:

(a) a halogenated hydantoin having a reduction potential from about −0.7 v to about +0.4 v compared to an Ag/AgCl reference electrode;

(b) an organoleptic effective amount of a fragrant agent which;

(i) is stable to the bleaching agent;

(ii) does not decompose the bleaching agent;

(iii) is not substantially hygroscopic wherein the fragrant agent is not an essential oil, extract, resin or synthetic oil; and wherein said fragrant agent comprises at least one compound selected from the group consisting of isoamyl phenyl ether, isoborneol, isoborneol methyl ether, 2,2-dimethylbicyclo[2.2.1]heptane-3-carboxylic acid, methyl ester, 2-tertiary pentyl cyclohexanyl acetate, 7-octen-2-ol-2,6-dimethyl acetate, 1-methyl-4-isopropyl cyclohexan-8-yl acetate, tetrahydrogeraniol, 2, 6-dimethylheptan-2-ol, diphenyl methane, diphenyl oxide, eucalyptol, alpha-fenchyl acetate, 1,3-dioxane-2,4,6-trimethyl-4-phenyl, 4-methyl-2-(2-methylpropyl) tetrahydro-2H-pyran-4-ol, ethyl tricyclo [5.2.1.02,6] decan-2-carboxylate, 2-methyldecanonitrile, 2-butyl-4,4,6-trimethyl-1,3-dioxane, 2-butyl-4,4,6-trimethyl-1,3-dioxane, limetol, 3,12-tridecadine nitrile, methyl lavender ketone, octanal dimethyl acetal, orange flower ether, p-tertiary butyl cyclohexanol, benzene pentanol, gammamethyl, 3-octanol, 3,7-dimethyl-3-octanol, 2,6-dimethyl-2-octanol, thymyl methyl ether, ortho-tertiary butyl cyclohexanyl acetate, benzene, 2-(1-ethoxyethoxy) ethyl-1-ethoxy-1-(2-phenylethoxy) ethane, cyclohexyl phenyl ethyl ether, 1-(4-isopropylcyclohexyl)ethanol, and bicyclo[2.2.1] heptane-2-ethyl-5(or 6)-methoxytricyclo[2.2.1.0.2.6] heptane, 1-ethyl-3-methoxy and (c) at least one of the following additives: a solubility modifier, a compaction aid, a filler, a surfactant, a dye, a dispersant, a binder, a lubricant/mold release agent, a detergent builder, a corrosion inhibitor, a chelant, a stabilizer, a biocide, a bromide source and an oxidizing halogenated biocide;

said shaped fragranced bleaching block formed by the method of claim 1.

3. A shaped fragranced bleaching block formed by the method of claim 1.

4. The shaped fragranced bleaching block of claim 3 wherein said fragrant agent comprises at least one compound selected from the group consisting of diphenyl methane; eucalyptol; and isopar J.

5. The shaped fragranced bleaching block of claim 3, wherein said fragrant agent comprises at least one compound selected from the group consisting of isoborneol, isoborneol methyl ether; tetrahydrogeraniol; diphenyl methane; eucalyptol (1,8-cineole); fruitate; octacetal; and isopar M.

6. The shaped fragrant bleaching block of claim 3, wherein said fragrant agent comprises at least one compound selected from the group consisting of 7-octen-2-ol-2,6-dimethyl acetate, 1-methyl-4-isopropyl cyclohexan-8-yl acetate, and 3,7-dimethyl-3-octanol.

7. The shaped fragranced bleaching block of claim 3, wherein said fragrant agent comprises at least one compound selected from the group consisting of 7-octen-2-ol-2,6-dimethyl acetate; alpha-fenchyl acetate; and isoborneol methyl ether.

* * * * *